US009226538B2

(12) United States Patent
Kim

(10) Patent No.: US 9,226,538 B2
(45) Date of Patent: Jan. 5, 2016

(54) VISOR ADAPTED FOR HELMET OR HEAD ENGAGEMENT

(76) Inventor: Min Kim, Escondido, CA (US)

( * ) Notice: Subject to any disclaimer, the term of this patent is extended or adjusted under 35 U.S.C. 154(b) by 1020 days.

(21) Appl. No.: 12/987,996

(22) Filed: Jan. 10, 2011

(65) Prior Publication Data

US 2011/0167544 A1 Jul. 14, 2011

Related U.S. Application Data

(60) Provisional application No. 61/293,466, filed on Jan. 8, 2010.

(51) Int. Cl.
*A42B 3/22* (2006.01)

(52) U.S. Cl.
CPC ..... *A42B 3/227* (2013.01)

(58) Field of Classification Search
CPC ..... A42B 1/062; A42B 1/064; A42B 1/068; A42B 1/024; A42B 1/247; A42B 3/221; A42B 3/227
USPC ..... 2/6.3, 6.5, 6.7, 10, 12, 15, 195.1, 195.2, 2/195.3, 195.4, 424
See application file for complete search history.

(56) References Cited

U.S. PATENT DOCUMENTS

| | | | | | |
|---|---|---|---|---|---|
| 642,440 | A * | 1/1900 | Gerstle | 2/10 |
| 1,175,167 | A * | 3/1916 | Morscherrosch | 2/195.1 |
| 1,266,503 | A * | 5/1918 | Liederman | 2/10 |
| 1,519,590 | A * | 12/1924 | Mull | 2/10 |
| 2,874,387 | A * | 2/1959 | Bannister et al. | 2/195.1 |
| 4,292,689 | A * | 10/1981 | Townsend, Jr. | 2/12 |
| 4,896,375 | A * | 1/1990 | Colucci | 2/12 |
| 5,119,514 | A * | 6/1992 | Woehl | 2/172 |
| 5,406,645 | A * | 4/1995 | Lin | 2/10 |
| 5,487,191 | A * | 1/1996 | Ridley | 2/195.1 |
| 5,647,060 | A * | 7/1997 | Lee | 2/9 |
| 5,669,071 | A * | 9/1997 | Vu | 2/10 |
| 5,862,523 | A * | 1/1999 | Proctor | 2/209.11 |
| 5,996,125 | A * | 12/1999 | Garzone | 2/410 |
| 6,341,380 | B1 * | 1/2002 | Coleman | 2/175.1 |
| 6,546,559 | B1 * | 4/2003 | Bronson | 2/12 |
| 7,082,618 | B1 * | 8/2006 | Muso | 2/175.1 |
| 7,258,436 | B2 * | 8/2007 | Heil | 351/155 |
| 7,398,560 | B1 * | 7/2008 | Swensen | 2/182.3 |
| D657,501 | S * | 4/2012 | Arousa | D29/122 |
| 2004/0006807 | A1 * | 1/2004 | Wang | 2/195.1 |
| 2004/0040067 | A1 * | 3/2004 | Pong | 2/195.2 |
| 2004/0231033 | A1 * | 11/2004 | Cho | 2/195.1 |
| 2007/0061937 | A1 * | 3/2007 | Curle | 2/12 |
| 2008/0066216 | A1 * | 3/2008 | Yun | 2/410 |
| 2009/0025113 | A1 * | 1/2009 | Kelleghan | 2/12 |
| 2009/0049578 | A1 * | 2/2009 | Toyohiro | 2/69 |
| 2009/0126076 | A1 * | 5/2009 | Ochoa | 2/171.3 |

* cited by examiner

*Primary Examiner* — Danny Worrell
(74) *Attorney, Agent, or Firm* — Donn K. Harms

(57) ABSTRACT

A visor configured for engagement to a riding helmet for horseback riders in an as-used position. The visor has an extra long frontal bill which extends around the helmet to side portions. The bill protects the eyes and most of the rider's face from sun and the sides protect the ears and side of the face. An elastic band provides a biased engagement to a helmet and optional vent apertures and retainment clips are employable to hold the device to a helmet more securely in high wind.

7 Claims, 5 Drawing Sheets

VISOR ADAPTED FOR HELMET OR HEAD ENGAGEMENT

This application claims Priority to U.S. Provisional Application No. 61/293,466 filed Jan. 8, 2010 and which is hereby incorporated herein in its entirety by reference.

FIELD OF THE INVENTION

The disclosed device relates to sun and glare protection. More particularly it relates to a visor adapted for engagement to a standard riding helmet for horseback riding or to the head of a user. The visor is adapted with a substantially transparent bill to provide riders with an overhead view of potential injurious branches and such encountered in an elevated position by a horse. The bill is formed of lightweight polycarbonate material and extends a distance sufficient to shade the entire face of the rider.

BACKGROUND OF THE INVENTION

Many outdoor sporting and hobby activities such as horseback riding, expose the rider to the full spectrum of sunlight when carried out during the daytime. Since riders and others outdoors are engaged in enjoyable activities, they tend to play and ride outdoors for extended periods of time. During this time the riders can therefore have their skin exposed to a considerable amount of sunlight which can cause sunburn and skin damage. Even with protective sunscreen lotion on their skin, such riders are still exposed for prolonged periods to light spectrums not blocked by sunscreen, and to the UV light blocked by sunscreen which has deteriorated.

Such prolonged exposure to sunlight can cause skin aging, sunburn, and cellular damage, especially to the skin of the face, since the majority of the rest of the body may be covered by clothing. Such damage, in addition to an aged appearance, can also result in skin cancer. Consequently, a shading of the face is especially preferable, especially in sports like horseback riding.

The sport of horseback riding conventionally employs helmets for riders. However, for fashion, tradition, or other reasons, most riding helmets possess little or no bill projecting forward of the front of the helmet. The conventional bills are deficient to shade even the forehead of the user sufficiently and totally lack a distance of extension that will provide shade to the face of the user.

One reason for the lack of such an extending bill, is the fact that horseback riders, during a riding session, are mounted on horseback. Situated on a saddle or horse, with their torso extending even higher, positions the rider's head a considerable distance above the head of a human simply walking on the ground. Consequently, riders are in danger of striking low hanging branches, wires, and other hazards while moving on horseback, which are not encountered by walkers. For this reason, and for tradition and fashion purposes, the riding helmet bill lacks extension from the helmet, least it block the user's view overhead which allows them to duck or otherwise avoid hazards.

Visors adapted to fit the head of users exist, however conventional such visors lack sufficient extension forward of the user's face, to shade the entire face from the overhead sun. Further, such visors are generally formed from canvas or cotton material and stiffeners which can make them heavy during long periods of wear. Still further, such visor bills are solid and impair the overhead view of the user and are thus not advisable for use in horseback riding, least the rider fail to see an overhead hazard and become injured during a ride.

As such, there exists an unmet need for a visor which may be temporarily engaged to a riding helmet so that it may be removed for competitions and the like to maintain a conventional and traditional appearance. Such a visor should have a bill with an extension forward of the user's face sufficient to shade the entire face during the daytime and late afternoon. Such a visor with such an elongated bill should also provide the user with a view overhead during use, thereby allowing the user to duck or take evasive action from hazards overhead while elevated on a horse.

Still further, such a visor device, while adapted to engage on a helmet, should have sufficient inward bias to maintain a grip on the helmet during high speed riding of the horse. However the band gripping the helmet, should also be of a material that is soft and will slide easily over the forehead of the user should the visor be mounted to their head without the helmet.

In this respect, before explaining at least one embodiment of the helmet and head engageable visor with extended bill herein in detail, it is to be understood that the invention is not limited in its application to the details of construction and to the arrangement of the components set forth in the following description or illustrated in the drawings nor the steps outlined in the specification. The disclosed visor for head or helmet engagement providing overhead viewing through the bill, is capable of other embodiments and of being practiced and carried out in various ways as those skilled in the art will readily ascertain once educated in the novel device and method of this application.

Also, it is to be understood that the phraseology and terminology employed herein are for the purpose of description and should not be regarded as limiting in any manner. As such, those skilled in the art will appreciate that the conception upon which this disclosure is based may readily be utilized as a basis for designing other methods and systems for carrying out the several purposes of the engageable head visor device with extended bill as disclosed herein. It is important, therefore, that the claims be regarded as including such equivalent construction insofar as they do not depart from the spirit and scope of the present invention.

OBJECTS OF THE INVENTION

An object of this invention is the provision of a visor that may be engaged on both a helmet of a horseback or vehicle rider as well as comfortably on a human head.

An additional object of this invention is the provision of such visor which has an extended projection from the helmet sufficient to shade the entire face of the user.

Yet another object is the provision of such a visor with such an extended bill, which also provides a view overhead of the user to allow them to avoid overhead hazards.

These together with other objects and advantages of the disclosed visor device will become subsequently apparent to those skilled in the art, reside in the details of the construction and method herein as more fully hereinafter described and claimed, reference being had to the accompanying drawings forming a part thereof, wherein like numerals refer to like parts throughout.

SUMMARY OF THE INVENTION

The disclosed device herein addresses the foregoing shortcomings of the prior art in head visors. The disclosed device provides a visor adapted to engage with a helmet of a horseback rider in a biased frictional engagement to avoid dislodgement. In the event of dislodgement during a high speed ride, a tether is employable to secure the helmet band and bill to the user. This is particularly preferred to prevent the need for a horseback rider to dismount to retrieve the visor should wind or riding dismount it.

The visor includes an extended bill which engages the band at a first end and extends a distance much longer than conventional visors. This extended distance provides a means to shade the entire face of the user, even during the afternoon.

In spite of the extended distance, making the bill larger, it is formed of thin substrate of substantially transparent material such as polycarbonate. The transparency of the material provides the user a means to see through the extended bill for hazards. The thin material is also extremely lightweight and even with the over-extension, compared to conventional bills, is lighter in weight.

Engagement to the user's head or a rider's helmet is accomplished with the provided band which is in a fixed engagement to a first side of the bill. This first side of the bill is cut in an arched shape which provides a means to curve the shape of the bill when it is in its biased frictional engagement to the helmet, or head of a user. The arch additionally is in a curve that extends the bill around the head of the user slightly past the forehead to thereby form a bill extending to the sides of the helmet or head during use. The thin polycarbonate or similar material block UV light from reaching the user's face, and forms a curve or arched shape in front of the user's face and extending to the sides and over the ears through the mounting with the band. Once removed however, the bill is able to reassume a substantially planar shape for easy transport and flat storage.

In use, the rider or user is fully protected on their entire face and ears by the UV blockage provided by the polycarbonate bill extending forward and around the helmet or head. The light weight of the material helps avoid neck fatigue.

Finally, a strap or lanyard is affixed to the rear portion of the band. A distal end of the strap has a clip or fastener adapted to engage the collar or clothing of the rider. This is a preferred feature in that the visor can dismount in heavy winds or high speed rides which normally would require the rider to turn around and dismount to pick up the visor. The strap however maintains the visor proximate to the user during such a dismount from the head or helmet.

The preceding and other features and advantages of this invention will become further apparent from the detailed discussion that follows. Such description is accompanied by a set of drawing figures. Numerals of the drawing figures, corresponding to those of the written description, point to the features of the invention with like numerals referring to like features throughout.

With respect to the above description then, it is to be realized that the optimum dimensional relationships for the parts of the invention, to include variations in size, materials, shape, form, function and manner of operation, manner of formation, assembly and use, are deemed readily apparent and obvious to one skilled in the art, and all equivalent relationships to those illustrated in the drawings and described in the specification are intended to be encompassed by the present invention. Therefore, the foregoing summary and following description are considered as illustrative only of the principles of the invention to form a lightweight visor with extended projection and concurrent overhead viewing to avoid hazards. Further, since numerous modifications and changes will readily occur to those skilled in the art, it is not desired to limit the invention to the exact construction and operation and steps of formation shown and described, and accordingly, all suitable modifications and equivalents may be resorted to, falling within the scope of the invention.

DETAILED DESCRIPTION OF THE INVENTION

Figure 1:
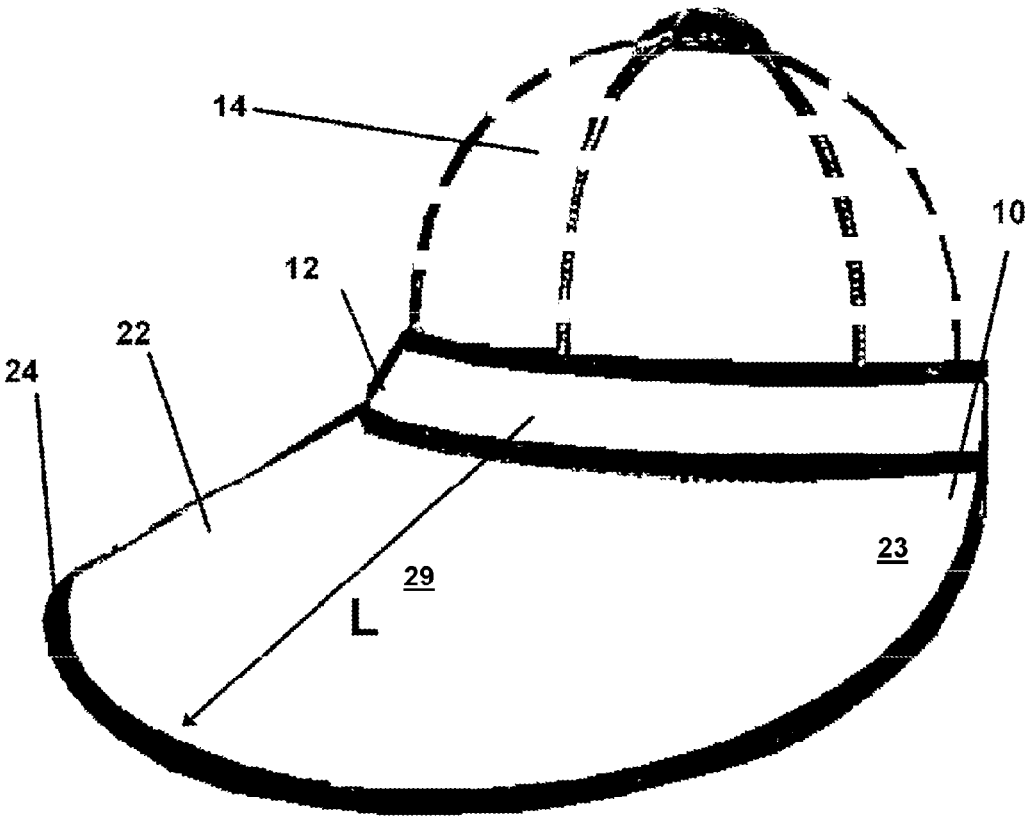
FIG. 1 is top plan view of the device showing it unmounted and the extra extension of the bill forward from the band.

Now referring to drawings in FIGS. 1-5, wherein similar components are identified by like reference numerals, there is seen in FIG. 1, the device 10 for engagement in combination with a conventional horseback riding helmet 14 which typically have a very short brim 11 (FIG. 4) which is at best insufficient to shade a rider's face and eyes during the day from over exposure to the sun. The device 10, as noted, provides an extended bill 22 which projects from the device 10, and the riding helmet 14 when attached, to significantly improve the protection to the rider from the sun while still affording the rider a means to view above their head when riding elevated on a horse through the substantially transparent material forming the bill 22.

Means for engagement to the helmet 14 is provided by a band 12 adapted for a stretched and biased engagement around a helmet 14 or the user's head. The two ends of the band 12 are engaged to hold the band elongated and biasing inward using fasteners 16 at the distal end of the band 12. The fasteners may be clips, hook and loop fabric, or other cooperatively engageable fastener halves and any such fastener as would occur to those skilled in the art are anticipated. The band 12 is as noted material having an elastic elongating nature preferably in order to exerted an inward bias to the circle of material formed by the engaged ends of the band 12. This inward bias provides a means to frictionally and compressibly engage around the circumference of a conventional rider's helmet 14 and to maintain the device 10 cooperatively engaged with the helmet 14 during riding to keep it from flying off during slow paced riding.

Preferably the inside surface 13 of the band 12 should be smooth and comfortable to fit a head or the helmet of a user as the biased engagement around the helmet 14 will hold it in place. The smooth surface 13 can be enhanced by coating or adding a layer of vinyl or smooth flexible plastic material on the inside surface 13 in areas where contact with the helmet 14 exterior are anticipated. Such conventionally worn helmets 14 are frequently covered with felt or other fabric which could be damaged by a rough or frictional fabric material over long periods of engagement. However a smooth surface 13 when in a biased engagement will both hold well to the helmet 14 and protect it from abrasion.

A safety strap 20 having an alligator clip 26 or similar gripping type fastener, to engage the user's clothing, or the helmet 14 may be provided to maintain the device 10 proximate to the user in case of dismount which could occur in high wind or when riding fast on a horse, which imparts a higher force on the device 10 than a walk or trot. Other modes of holding the device 10 to the helmet 14 are shown in subsequent figures.

Figure 2:
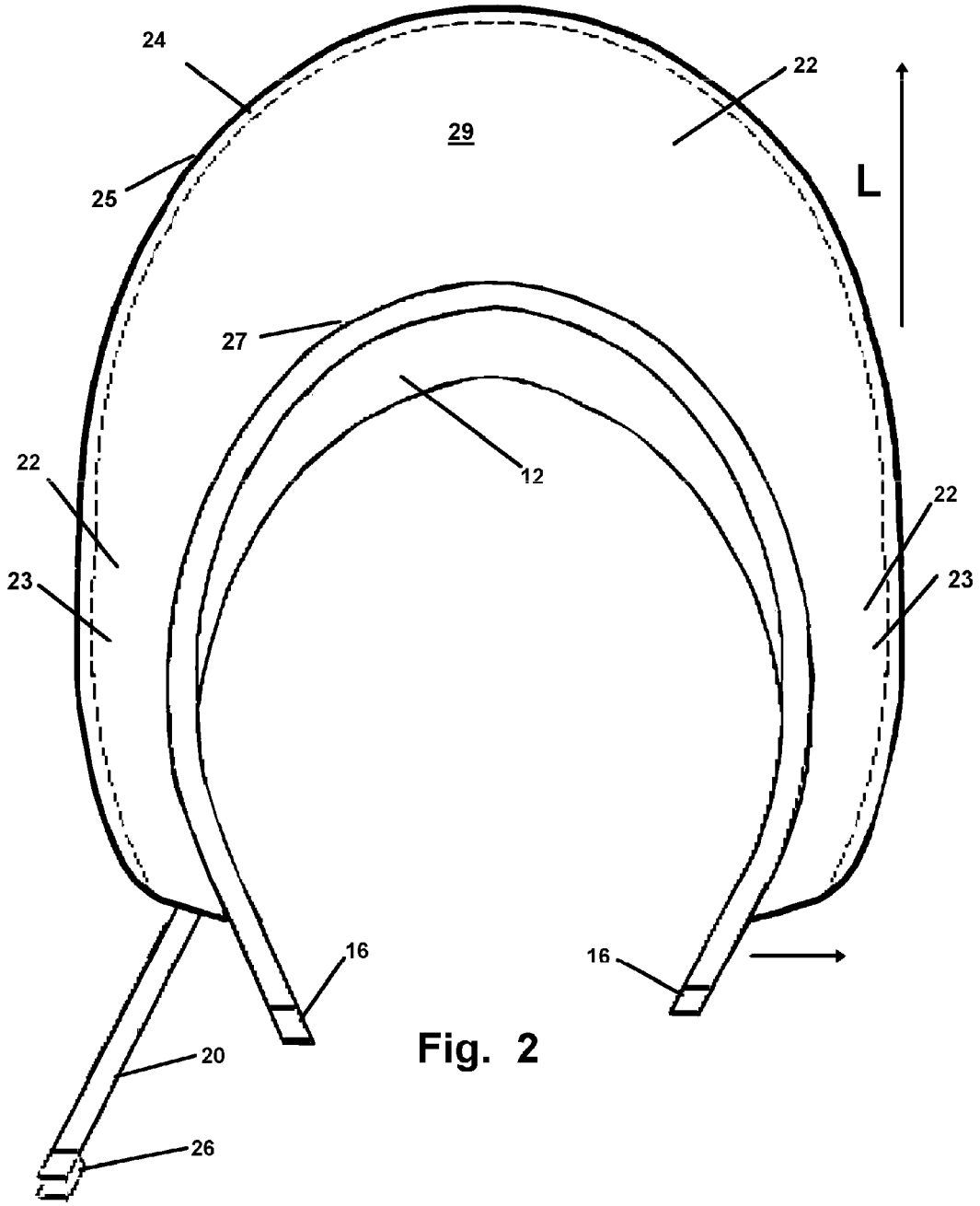
FIG. 2 shows a perspective view of the device in the as-used position, engaged upon a conventional riding helmet shown in dotted line, and having a frontal portion of the bill in an arch, projecting a distance "L" forward from the helmet.

Shown in FIG. 2, arched higher in the middle and descending to the lower side 23 portions, the bill 22 is formed of substantially transparent material which may be tinted, and extends a distance "L" forward from the band 12 and projects in front of the helmet brim 11, such that the entire face of the user is shaded. This is most desirable to riders who are outdoors riding frequently. An edging 24 is engaged upon the perimeter of the bill 22 as a means to protect the edge and surrounds the exterior perimeter arch 25 of the bill 22. The interior arch 27 of the bill 22 attached to or adjacent to the band 12, is cut in a steeper arch angle than the exterior arch 25, such that a biasing of the band 12 around a head or helmet 14, will cause a horizontal curve or arch in the bill 22 when extending from the helmet 14. Consequently, while the bill 22 lies substantially planar when not engaged to the helmet 14, once in a biased engagement thereon, the bill 22 arches causing the sides 23 of the bill 22 to curve downward with the edging 24 defining the distal edge of the bill 22 assuming a position lower than the inside edge running along the interior arch 27. The frontal portion 29 of the bill 22, arches such that the arch of the bill 29 in the middle area of the frontal portion 29 is highest, and it descends to the sides 23.

This arching of the bill 22 caused by the biased engagement of the band 12 to the helmet 14 perimeter, provides a means to lower the sides 23 of the bill 22 to better protect the ears and sides of the user's face, while raising the middle portion of the frontal portion 29 to give the user's eyes a better view forward than if the bill 22 were not arched upward. When riding elevated upon a horse, it is most important to see clearly, while also protecting the rider from harm from UV and sunlight.

While affording the rider excellent protection from overhead sun, the transparent nature of the bill 22 provides the user a means to see and ascertain overhead hazards such as poles or tree limbs when wearing the device 10 while riding. The material forming the bill is UV blocking material such as polycarbonate material which is also very light weight and somewhat rigid when pulled by the biased band to which it is engaged. As noted, the biased engagement to the helmet 14 and the resulting arch of the frontal portion 29, higher in the middle area and lower toward the sides 23, provides support to the frontal portion 29 from this arch, and allows for the elongated projection "L" of the bill 22 without having to add more support which would make it too heavy.

As noted, the bill 22 follows a circular path around the helmet 14 and provides an extension which curves lower on the sides 23 to cover over the ears as well as the sides of the face. The transparent fabric of the bill 22 may be tinted or otherwise colored to protect from glare or clear depending on user preference. It may also be polarized to provide superior glare protection.

Figure 3:
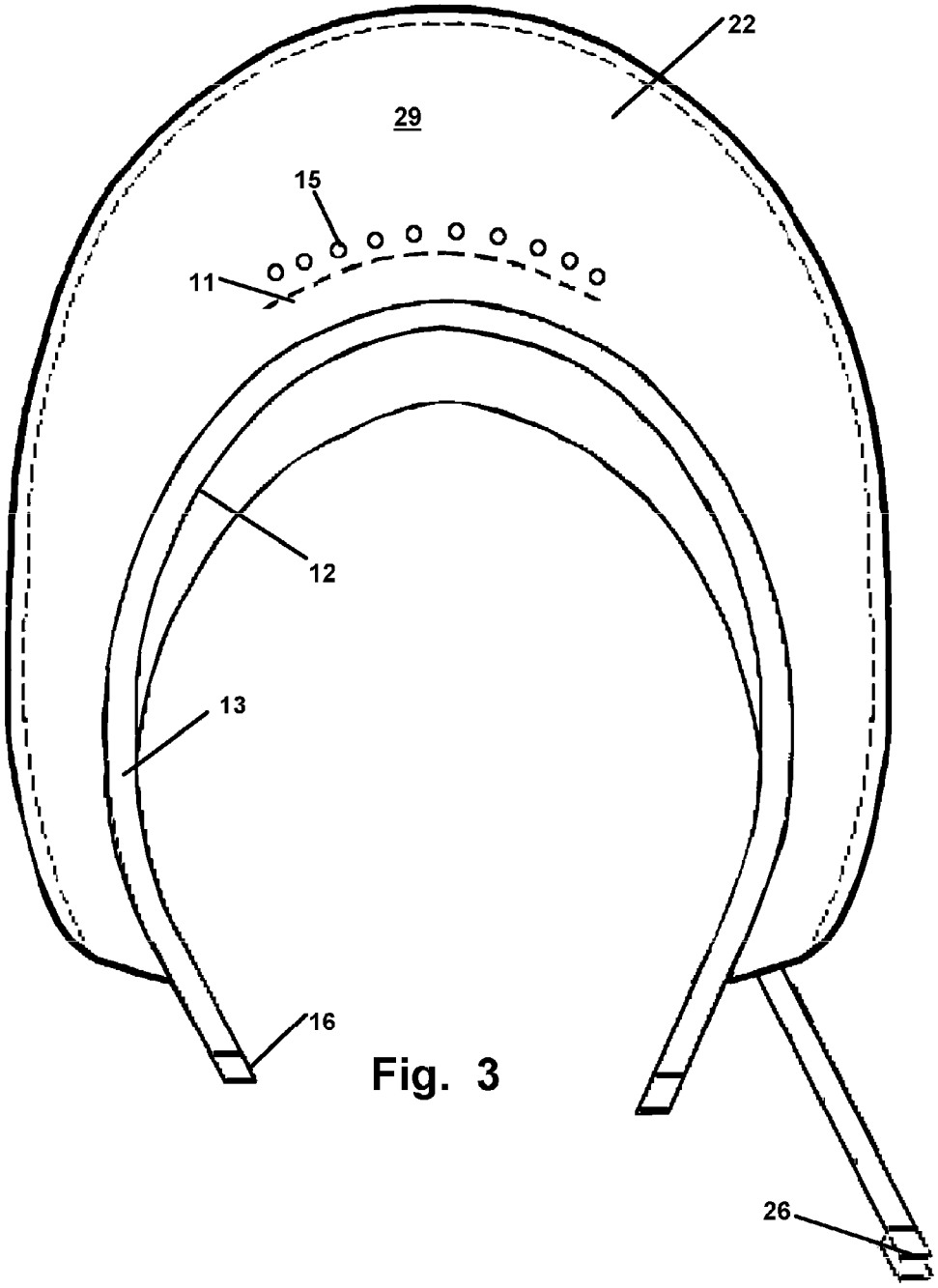
FIG. 3 depicts a bottom view of the device as in FIG. 1, and showing ventilation holes formed in the bill.

FIG. 3 depicts a bottom view of the device 10 as in FIG. 1, and showing optional ventilation apertures 15 communicating through the bill 22 in the frontal portion 29 and positioned to be just in front of the helmet brim 11 when the device 10 is engaged to the helmet 14 in an as-used position. The apertures 15 provide a means to ventilate the area under the bill 22 and just in front of the user's eyes when wearing the device 10 on their helmet 14. It also provides a relief for air building up under the bill 22 when riding fast from the wind in the user's face.

Figure 4:
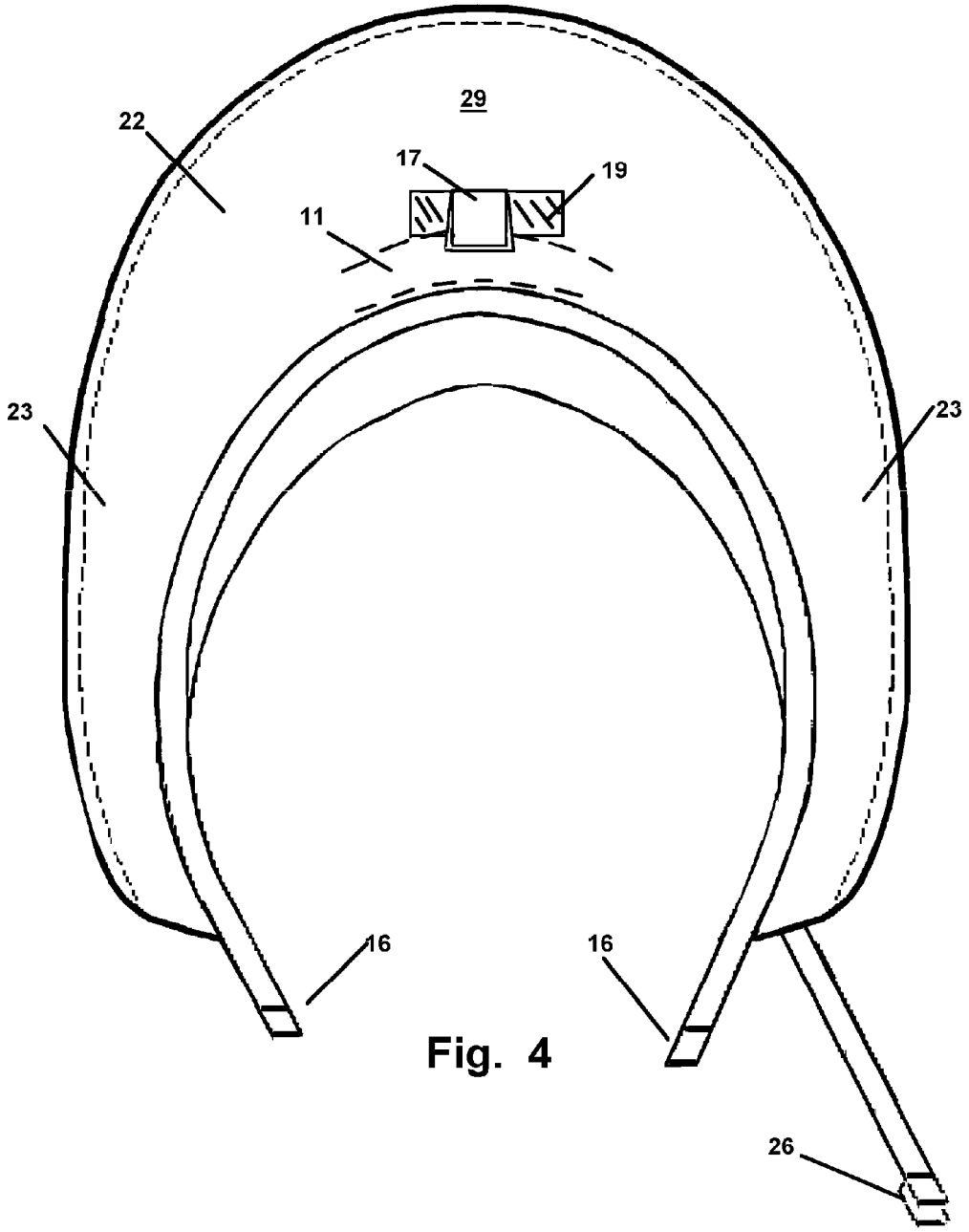
FIG. 4 depicts the device of FIG. 1 from a bottom view showing the optional but preferred clip for engagement to the conventional bill of a riding helmet shown in dotted line.

FIG. 4 depicts the device of FIG. 1 from a bottom view showing the optional but preferred clip 17. The clip 17 is positioned on the bottom surface of the frontal portion 29 of the bill 22 in a position such that it may be clipped upon the projecting brim 11 of a helmet 14. The clip 17 would be spring loaded, or otherwise configured to engageable in a biased engagement with the brim 11. Optionally, because the helmet brims 11 can vary in size or projection, the clip 17 may be engaged upon piece of elastic material 19 which would be engaged to the bill 22. This allows the clip 17 a means for a floating mount to the device 10 or the bill 22, allowing it to be moved toward or away from the helmet 14 when engaging it to a helmet brim 11.

Figure 5:
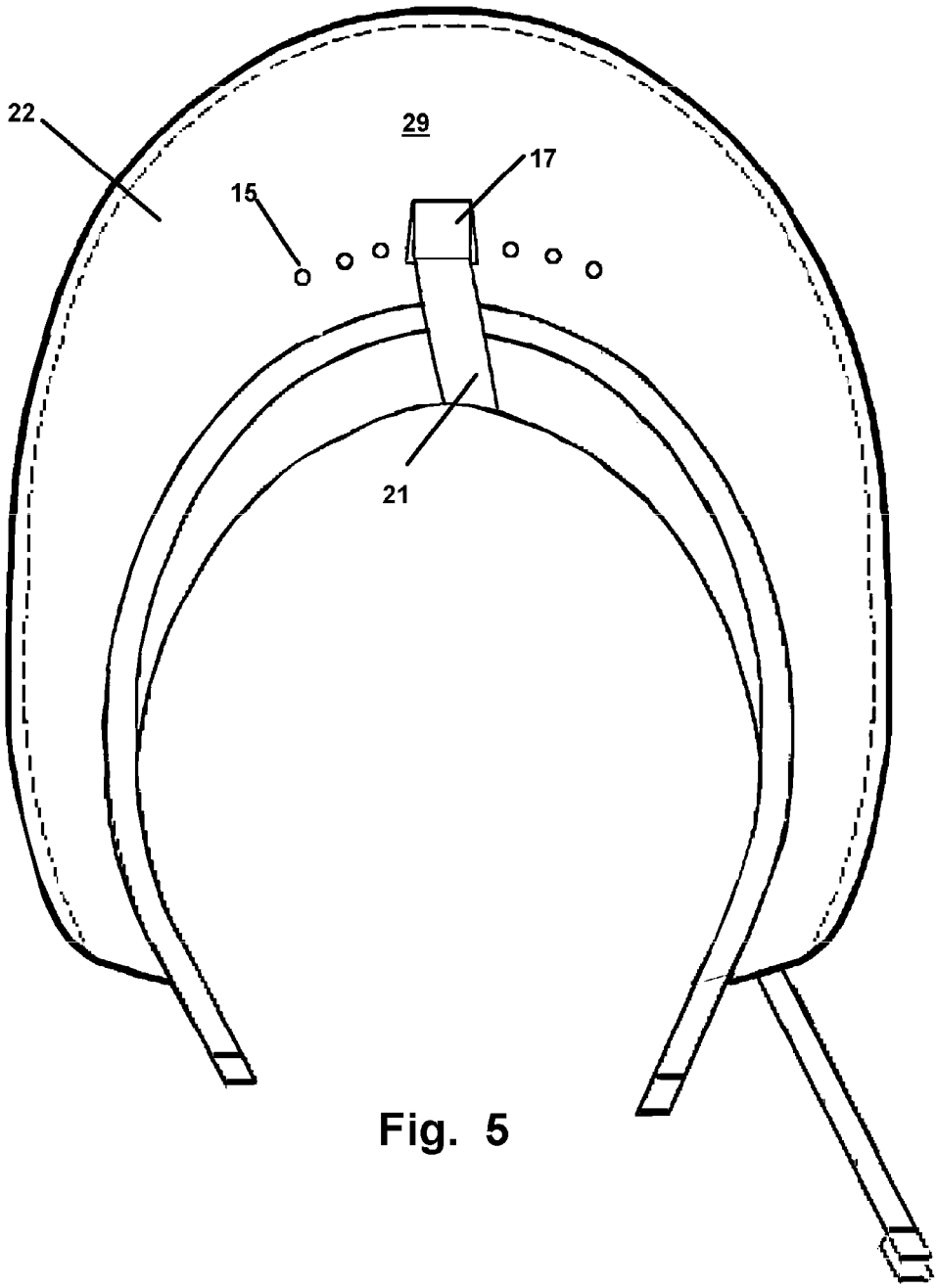
FIG. 5 depicts a bottom view of the device of FIG. 3 showing a strap and clip for engagement to the conventional bill of a riding helmet.

FIG. 5 depicts a bottom view of the device of FIG. 3 showing a strap 21 and clip 17 for engagement to the conventional brim 11 of a riding helmet 14. The strap 21 may be elastic material and is engaged to the clip 21 on a distal end and to the device 10 on the opposite end. The strap 21 allows the clip 17 to be engaged to the distal edge of the helmet bill 11 and provides a means for a floating mount of the clip 17 to the device 10 to accommodate any differing sized brims 11 which the user might encounter. In the device of FIGS. 4 and 5, the clip 17 provides a means to hold the bill 22 down under the pressure of wind which the user might encounter from weather or riding at higher speeds. By holding the bill 22 down and against the helmet brim 11 the device in the as-used position engaged to a helmet 14 is much more secure from a dismount.

While all of the fundamental characteristics and features of the visor device adapted for head or helmet engagement and having an long projecting bill, been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A visor configured for an engagement to horseback riding helmet having a brim, said visor comprising:

an elongated band configured for an engagement to said riding helmet to hold said visor in an as-used position;

a substantially transparent bill extending a distance to an outside edge, from an inside edge connected to said band;

said bill having a frontal portion projecting away from said inside edge;

said bill having two side portions projecting away from said inside edge on opposite sides of said riding helmet;

said frontal portion positioned above and in front of the eyes of a rider wearing said helmet with said visor in said as-used position;

a clip, said clip positionable to a floating engagement with said brim through an elastic mount communicating between said clip and said visor, or, an elongated strap communicating between said clip and one of said frontal portion of said bill, or said band adjacent to said frontal portion of said bill;

a view through said transparent bill providing said user riding on a horse, means to see overhead obstacles; and said side portions extending rearward of said frontal portion over the ears of said rider wearing said helmet with said visor in said as-used position, thereby providing means to shade said ears and the sides of said rider's face and said clip removably engaged with said bill maintains said visor in said as-used position during said periods of increased wind.

2. The visor of claim 1 additionally comprising:

one or a plurality of apertures communicating through said brim adjacent to said frontal portion of said brim; and said apertures providing means to vent air from underneath said brim while said visor is in said as-used position.

3. The visor of claim 1 additionally comprising:

a secondary strap engaged to said visor on a first end and to a removable engageable fastener at a second end; and said removably engageable fastener attachable to clothing worn by said rider to provide a means to maintain said visor adjacent to said rider should said visor become disengaged from said riding helmet.

4. The visor of claim 2 additionally comprising:

a secondary strap engaged to said visor on a first end and to a removable engageable fastener at a second end; and said removably engageable fastener attachable to clothing worn by said rider to provide a means to maintain said visor adjacent to said rider should said visor become disengaged from said riding helmet.

5. The visor of claim 1 additionally comprising:

said band formed of elastic material; and said band providing a biased engagement of said band to said riding helmet from a compressive force imparted to said riding helmet from said band engaged thereon.

6. The visor of claim 2 additionally comprising:

said band formed of elastic material; and said band providing a biased engagement of said band to said riding helmet from a compressive force imparted to said riding helmet from said band engaged thereon.

7. The visor of claim 3 additionally comprising:

said band formed of elastic material; and said band providing a biased engagement of said band to said riding helmet from a compressive force imparted to said riding helmet from said band engaged thereon.

* * * * *